United States Patent [19]

Grunert et al.

[11] Patent Number: 4,725,800

[45] Date of Patent: Feb. 16, 1988

[54] CIRCUIT BREAKER WITH MAGNETIC SHUNT HOLD BACK CIRCUIT

[75] Inventors: Kurt A. Grunert; Stephen A. Mrenna; James P. Ellsworth, all of Beaver, Pa.

[73] Assignee: Westinghouse Electric Corp., Pittsburgh, Pa.

[21] Appl. No.: 3,531

[22] Filed: Jan. 15, 1987

[51] Int. Cl.[4] ..... H01H 75/10; H01H 73/36

[52] U.S. Cl. ..... 335/38; 335/35; 335/174

[58] Field of Search ..... 335/35, 36, 37, 38, 335/23, 174, 279

[56] References Cited

U.S. PATENT DOCUMENTS 2,939,929 6/1960 Hobson ..... 335/38

*Primary Examiner*—E. A. Goldberg
*Assistant Examiner*—Lincoln Donovan
*Attorney, Agent, or Firm*—L. P. Johns

[57] ABSTRACT

A circuit breaker structure having a faster trip unit characterized by a circuit breaker operator and a trip unit comprising a coil, a core, and an armature, and a hold-back bracket extending from and retaining the armature in a spaced position from the core so as to cause the magnetic field lines to flow through the bracket and the armature.

8 Claims, 7 Drawing Figures

CIRCUIT BREAKER WITH MAGNETIC SHUNT HOLD BACK CIRCUIT

CROSS REFERENCE TO RELATED APPLICATION

This application is related to copending applications Ser. No. 858,137, filed Apr. 30, 1986, entitled "Circuit Breaker With Adjustable Magnetic Trip Unit", of which the inventors are S. A. Mrenna and M. Whipple, and Ser. No. 913,877, filed Sept. 30, 1986, entitled "Circuit Breaker with Magnetic Shunt Hold Back Circuit", of which the inventors are Kurt A. Grunert, Stephen A. Mrenna, Jonathan Weiss, and Vijay K. Garg, both assigned to the assignee of this application.

BACKGROUND OF THE INVENTION

1. Field of the Invention

This invention relates to a circuit breaker having a faster acting trip unit and, more particularly, it pertains to a magnetic shunt hold back circuit in which magnetic flux lines are concentrated between a core and armature.

2. Description of the Prior Art

The circuit-interrupting art is everchanging and compact circuit breakers have evolved that comprise overcurrent protective devices, or trip units, that function in response to abnormal currents, such as overcurrents, ground fault currents, and short circuits, that occur in an electrical distribution system. Such trip units are disclosed in U.S. Pat. Nos. 3,530,414; 3,797,007; 3,808,847; 3,815,064; 3,950,716; 3,950,717; 4,074,218; and 4,313,098. Though these circuit breakers have a greater range for adjusting for specific trip currents between maximum and minimum air gaps between the magnet and the armature of the trip units, there is a need for a device that provides for faster tripping action at a predetermined overcurrent condition. This is especially true for fast acting current limiting circuit breakers.

The invention entitled "Circuit Breaker with Magnetic Shunt Hold Back Circuit", Ser. No. 858,137, filed Sept. 30, 1986, comprises means for calibrating a circuit breaker that also includes a hold-back bracket. But where the parts and assembly are provided free or substantially free of defects for required ratings, means for calibration are usually unnecessary.

SUMMARY OF THE INVENTION

In accordance with this invention, it has been found that a circuit breaker structure having a faster trip action is comprised of a circuit breaker mechanism having separable contacts and having a releasable member movable to an unlatched position from a latched position to effect opening of the contacts; a latch lever movable between latched and unlatched positions of the releasable member and being biased in the latched position; a trip bar movable to unlatch the latch lever and being biased in the latched position; a trip unit comprising a stationary magnetic structure for each conductor of the distribution system and including a coil and first core assembly and an armature; lever means associated with each stationary magnetic structure for moving the trip bar to the unlatched position; the lever means comprising the armature and movable toward the core in response to abnormal currents in at least one of the conductors; a hold-back bracket mounted on the core and comprising a pair of inturned flanges spaced from the core; the armature being disposed between the core and the flanges so as to increase the magnetic flux density between the core and the armature; and the hold-back bracket extending along the core and beyond the armature, so as to cause magnetic field lines to flow through the flanges.

The advantage of the circuit breaker of this invention is that it provides an improved trip unit for decreasing the unlatching time on a short circuit.

DESCRIPTION OF THE PREFERRED EMBODIMENTS

The circuit breaker mechanism of this invention is of the type that is generally described in U.S. Pat. No. 3,797,007 which is incorporated by reference herein.

Figure 1:
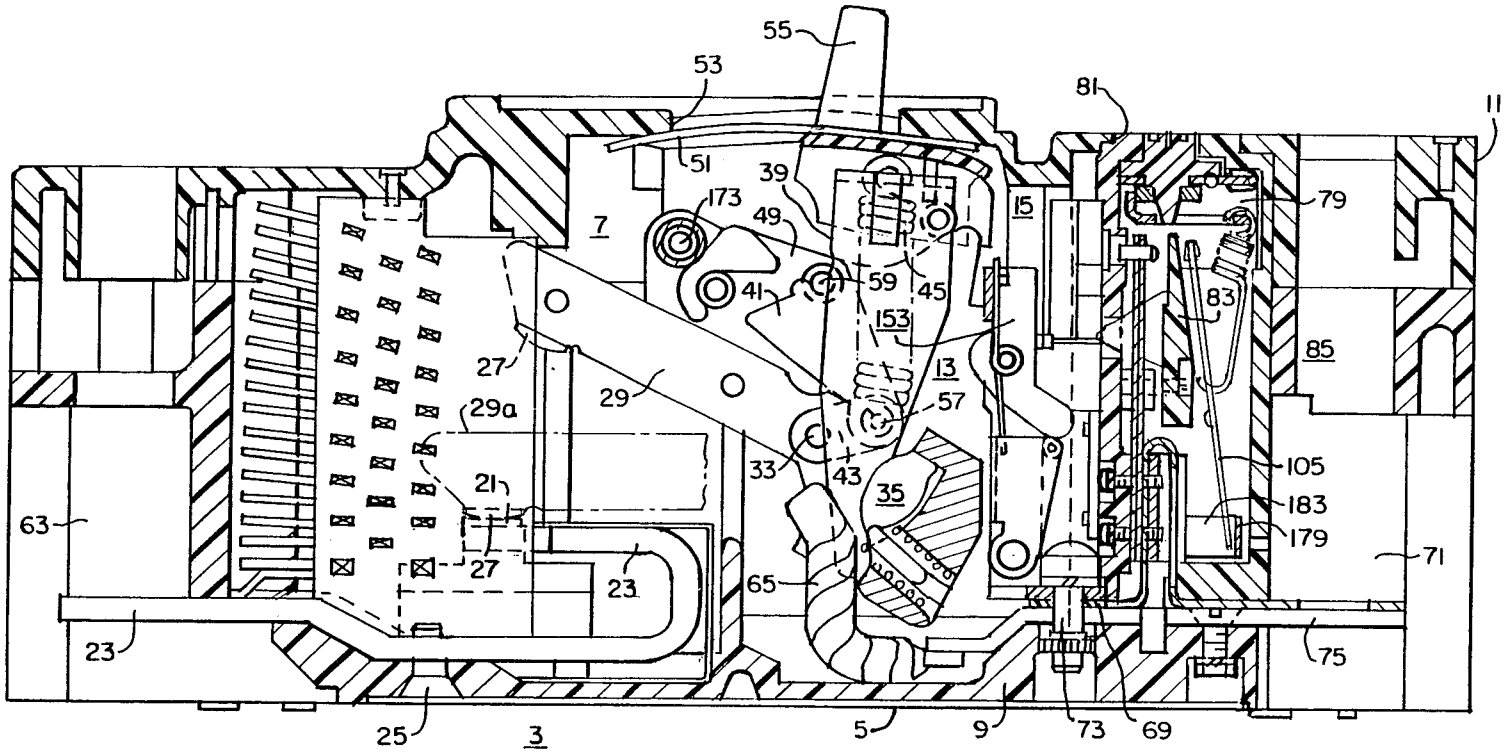
FIG. 1 is a vertical sectional view of a multi-pole circuit breaker in accordance with this invention.

In FIG. 1, a circuit breaker is generally indicated at 3 and it comprises an insulating housing 5 and a circuit breaker mechanism 7 supported within the housing. The housing 5 comprises an insulating base 9 and an insulating cover 11.

The circuit breaker mechanism 7 comprises an operating mechanism 13, and a latch and trip device 15. The circuit breaker 3 is a three-pole circuit breaker comprising three compartments disposed in side-by-side relationship. The center pole compartment (FIG. 1) is separated from the two outer pole compartments by insulating barrier walls formed with the housing base 9 and cover 11. The operating mechanism 13 is disposed in the center pole compartment and is a single operating mechanism for operating the contacts of all three pole units.

Each pole unit comprises a stationary contact 21 that is fixedly secured to a rigid main conductor 23 that in turn is secured to the base 9 by bolts 25. In each pole unit, a movable contact 27 is secured, such as by welding or brazing, to a contact arm 29 that is mounted on a pivot pin 33. The arm 29 for all three of the pole units is supported at one end thereof and rigidly connected on a common insulating tie bar 35 by which the arms of all three pole units move in unison. Each of the contact arms 29 is biased about the associated pivot pin 33.

The operating mechanism 13 actuates the switch arms 29 between open and closed positions. The mechanism comprises a pivoted formed operating lever 39, a toggle comprising two toggle links 41 and 43, overcenter spring 45 and a pivoted releasable cradle or arm 49 controlled by the trip device 15. An insulating shield 51 for substantially closing an opening 3 in the cover 11, is mounted on the outer end of the operating level 39 and has an integral handle portion 55 extending out through the opening to enable manual operation of the breaker. The toggle links 41 and 43 are pivotally connected together by a knee pivot pin 57. The toggle link 41 is pivotally connected to the releasable arm 49 by a pin 59, and the toggle link 43 is pivotally connected to the switch arm 31 of the center pole unit by the pin 33.

The overcenter spring 45 is connected under tension between the knee pivot pin 57 and the outer end of the operating lever 39. The circuit breaker is manually operated to the open position by movement of the handle portion 55 in a clockwise direction, which movement actuates the overcenter spring 45 to collapse the toggle links 41 and 43 to the "off" position (FIG. 1), and opening movement of the contact arm 29 for all of the pole units in a manner well known in the art.

The circuit breaker is manually closed by counterclockwise movement of the handle portion 55 from the "off" position to the "on" position, which movement causes the spring 45 to move overcenter and straighten the toggle links 41, 43, thereby moving the contact arm 29 for all of the pole units to the closed position as shown in broken line position 29*a*.

The trip device 15 serves to effect automatic release of the releasable cradle or arm 49 and opening of the breaker contacts for all of the pole units, in response to predetermined overload conditions in the circuit breaker through any or all pole units of the circuit breaker, in a manner described hereinbelow.

The circuit through each pole unit extends from a left-hand terminal 63 through the conductor 23, the contacts 21, 27, the contact arm 29, a flexible conductor 65, a conductor 67, a trip conductor 69, and to a right-hand terminal 71. Bolt 73 secures one end of the trip conductor 69 to the conductor 67 and the other end of the trip conductor 69 is disposed between a backup plate 75 and the terminal 71.

Figure 2:
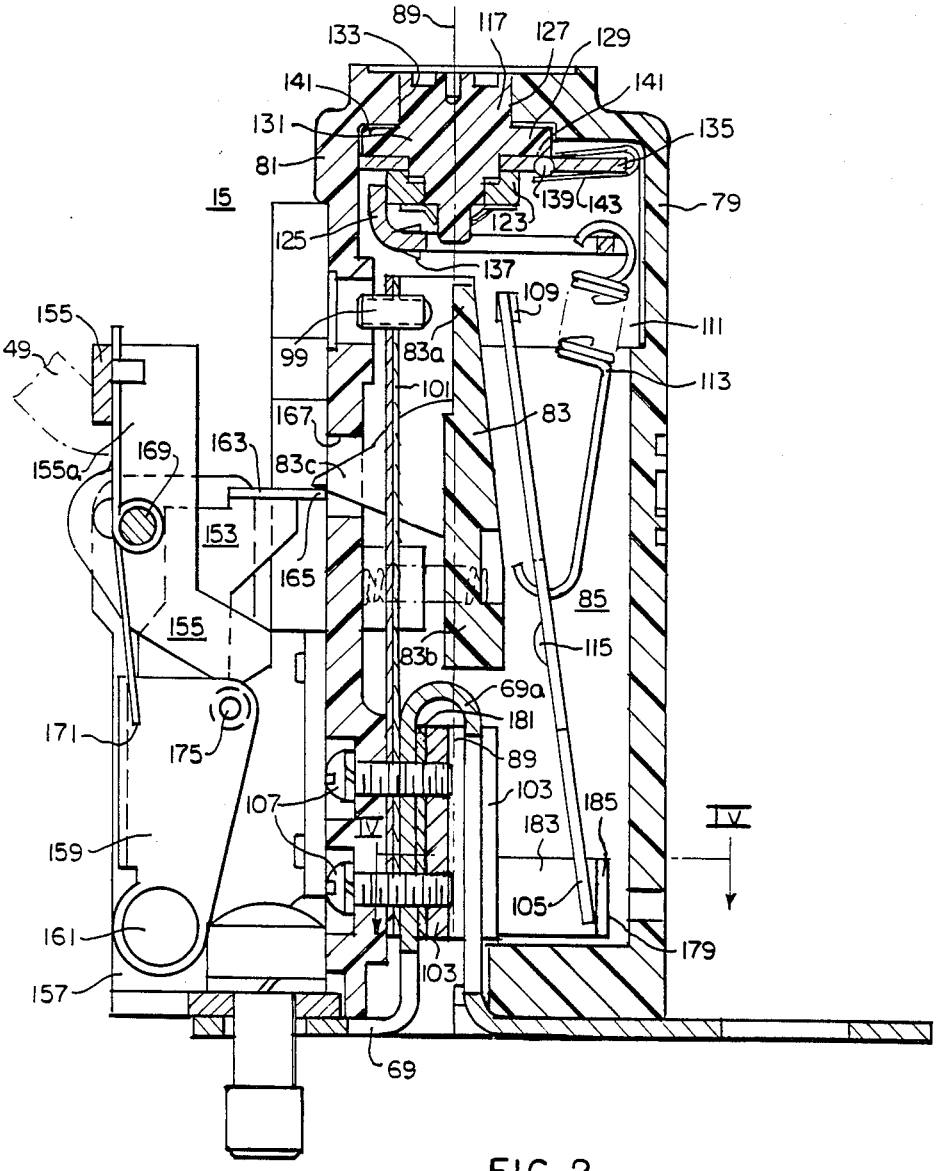
FIG. 2 is an enlarged vertical sectional view of a part of FIG. 1.

As shown in FIG. 2, the latch and trip device 15 comprises a molded insulating housing base 81 and a molded insulating housing cover 79 secured to the base to enclose a molded insulating trip bar 3 that is common to all three of the pole units. The base 81 (FIG. 2) includes a pair of similar spaced partitions of which one partition 85 is shown which are vertically disposed and integral with the base for separating the interior of the housing into three compartments, each compartment containing one of the three poles. In a similar manner, the cover 79 is provided with partitions corresponding to said spaced partitions and having mating surfaces therewith in a manner similar to the mating surfaces of the peripheral surfaces of the base 81 and cover 79 as indicated by a parting line 89.

The spaced partitions serve as journals for the trip bar 83. Accordingly, when the housing base 81 and cover 79 are assembled, the trip bar 3 is retained in place and is free to rotate. Each section of the trip bar 83 located within the space compartments of the housing comprises upper and lower portions 83*a* and 83*b*, which are above and below the axis of rotation of the trip bar. Each upper portion 83*a* cooperates with a screw 99 on a bimetal member 101 for adjusting the spacing between the upper ends of the bimetal member and the trip bar portion 83 in response to the degree of deflection of the upper end of the member 101 toward the member 83*a*, whereby the trip bar 83 is rotated clockwise by the bimetal member and thereby trips the circuit breaker to the open position. The lower end portion 83*b* of the trip bar 83 is rotated by an armature 105 in the manner described below.

The trip conductor 69 (FIG. 2) includes an inverted U-shaped intermediate portion 69*a* which constitutes a single loop of a stationary magnetic circuit, which comprises a magnetic core 103 and an armature 105. The assembly of the intermediate U-shaped portion 69*a*, the core 103, and the lower portion of the bimetal member 101 are secured in place by suitable means, such as screws 107, on the housing base 81. The lower end portion of the bimetal member 101 is in surface-to-surface contact with the conductor 69, whereby upon the occurrence of a lower persistent overload current below a predetermined value of, for example, five times normal rated current, the bimetal member 101 is heated and deflects to the right through an air gap dependent upon the setting of the screw 99. Thus, the trip bar 83 is actuated to trip the circuit breaker.

The armature 105 is pivotally mounted in an opening 109 on a holding bracket 111 and is biased in the counterclockwise direction by coil springs 113 (FIG. 2). The armature has a projection 115 and is movable clockwise against the spring to rotate the trip bar 83 clockwise. When an overload current above a value such, for example, as five times normal rated current or a short circuit current occurs, the stationary magnetic structure is energized and the armature 105 is attracted toward the core 103, causing release of the arm 49 and opening of the contacts 21 and 27.

The adjusting knob 117 is provided for changing the rating of the circuit breaker 15 by varying the force on the spring 113. The adjusting knob 117 is part of a spring tensioning assembly which also includes a cam 123, and a cam follower 125. The adjusting knob 117 includes a circular surface 127, a radial flange 129, and a shaft 131 on which the cam 123 is mounted. The adjusting knob 117 is mounted within a circular opening 133 of the housing. The adjusting knob 117 is retained in place by a retainer 135 which is part of the holding bracket 111.

The cam follower 125 is a lever, such as a bell crank, having one end portion contacting the surface of the cam 123 and the other end portion connected to the upper end of the coil spring 113. The lower end of the spring is connected to the armature 105. The cam follower is pivotally mounted in an opening 137 of the holding bracket 111. In this manner the tension of the spring 112 holds the cam follower 125 against the cam surface 123.

Associated with the adjusting knob 117 is an index means including a ball bearing 139, and spaced indentations 141 around the lower surface of the radial flange 129 for receiving the ball bearing at prescribed positions of rotation of the index knob 117. A leaf spring 143 retains the ball bearing in place within an aperture of the retainer 135. The ball bearing 139 provides positive indexing or indication of the position of the knob as established by the spaced positions of the indentations 141 around the flange 129. An advantage of the ball bearing 139 is that it reduces rotational friction by rolling on the surface of the flange 129, thereby facilitating rotation of the knob. When the ball bearing 139 is seated within an indentation 141, any vibrations occurring within the circuit breaker are less likely to change the setting of the knob and thereby alter the rating established thereby.

The mechanism by which the releasable arm 49 is released is shown in FIGS. 1, 2. The mechanism includes the trip bar 83, a trip lever 153, and a latch lever 155. A U-shaped mounting frame 157 is mounted on the base 81 with similar spaced upright sides 157 (one shown) providing mounting support for the levers. The trip lever 153 includes a U-shaped lever 159, the lower end of which is mounted on a pivot pin 161 which extends from the sides 157 of the frame. The U-shaped lower portion of the lever 159 maintains the lever upright adjacent the frame side 157. The upper end of the trip lever 153 includes a flange 163 which engages a notch 165 on the trip bar 83. As shown in FIG. 2 a portion of the trip bar extends through an opening 167 in the insulating base 81.

The latch lever 155 is mounted on a pivot pin 169 the similar opposite sides of the frame 157. A spring 171 is mounted on the pin 169 and has end portions engaging the levers 153 and 159 for biasing the levers in the latched positions. When the releasable arm 49 is in the latched position (FIG. 1), the arm, which is pivoted on a pivot pin 173, is secured in the latched position below the lever 155 and applies a rotatable force thereon. The latch lever 155 is prevented from turning due to engagement of the lower end of the lever on a pin 175 which is mounted in the U-shaped portion 159 on the trip lever 153. As a result of the rotating force on the latch lever 155, the trip lever 153 is biased clockwise and is prvented from movement by engagement of the flange 163 in the notch 165 of the trip bar 83. When the trip bar is rotated clockwise, the flange 163 is dislodged from the latched position within the notch 165 and the trip lever 153 rotates clockwise to move the pin 175 from engagement with the lower end of the latched lever 155. As a result the latch lever 155 is free to rotate about the pin 169 and thereby unlatch the releasable arm 49 from the latched position.

In the prior art unit (FIG. 3), when a predetermined overcurrent condition occurred through the conductor 69, magnetic flux lines 177 circulating in the core 103 and the armature 105 became sufficiently strong to attract and move the armature to the end faces of the core, thereby tripping the trip bar 83. However, it was found that there was not enough magnetic force to hold the armature all the way open or closed. At normal currents, the armature should be completely open. But if the spring 113 is adjusted sufficiently to hold the armature completely open, a response to lower fault current ratings is lost. This occurs particularly in the case of a current pulse that is above the threshold to cause a trip cycle, but of a short time duration (2 to 3 milliseconds). Here there is an initial pull of attraction for the armature 105, but not long enough to permit it to actuate the trip bar.

Between some current values, under short pulse condition found in fast acting current limiting circuit breakers, such as 12KAmp–18KAmp, there is sufficient current pulse to cause the arms 29 to open and stay open (due to a desirable "blow-open" action to cause current limiting), but not enough energy in the pulse to cause the trip bar to be operated. Thus, the breaker may have one arm 29 open. The trip indication via the handle 55 still indicates a breaker in the "on" mode; all due to the fact that the trip unit did not function.

Figure 4:
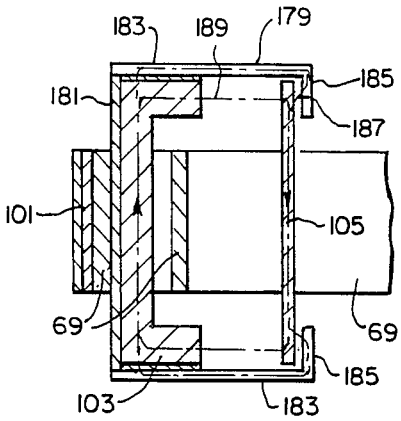
FIG. 4 is a horizontal sectional view taken on a line IV—IV of FIG. 2, through the core coil armature and hold-back bracket.

To correct this problem, in accordance with this invention, it was necessary to create a magnetic force greater than normal on the armature so that it would fully retract from the core under normal operating conditions. As shown in FIGS. 1, 2, 4, a hold-back bracket 179 is provided to generate a greater magnetic hold-back force between the core 103 and the armature 105. The hold-back bracket 179 is a generally U-shaped member having an intermediate portion 181, leg portions 183, and in-turned flange portions 185. The bracket 179 contributes an increased magnetic field density or holding force between the flanges 185 and the armature 105, thereby retaining the armature in a fully retracted position from the core 103 due to the concentration of magnetic flux lines in response to the presence of the bracket 179.

In the alternative, the intermediate portion 181 may be omitted (FIG. 5) with the legs 183 secured to the core 103 in a suitable manner, such as a weld.

Figure 3:
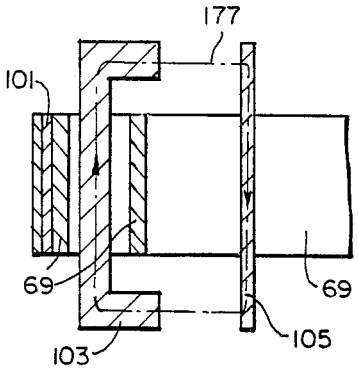
PRIOR ART FIG. 3.
FIG. 3 is a horizontal sectional view through the assembly of the conductor core and armature of a prior art unit.
Figure 5:
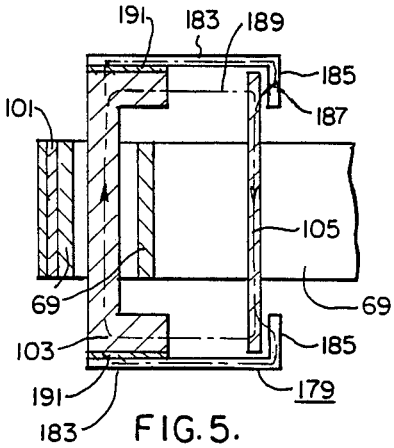

In the preferred embodiment of FIG. 5, the hold-back bracket 179 provides a solution to the problem of armature "hang-up" that existed with the prior art structure (FIG. 3). In the embodiment of FIG. 4, the bracket 179 performs the function of collecting and directing most of the magnetic field lines that would otherwise extend laterally away from the ends of the magnet 103, and through the legs 183 and the flanges 185 to the armature 105 such as shown by field lines 187. It is noted, however, that field lines 189 that ordinarily move between the legs of the magnet core 103 and the armature 105 continue as indicated in FIG. 4. By directing otherwise misguided filed lines 187 to and through the armature 105, a greater hold-back force is applied thereto to avoid the problem of the prior art as set forth above. In the preferred embodiment of the invention (FIG. 5) in which the intermediate portion 181 (FIG. 4) is omitted, the leg portions 183 thereof are secured at 191 in a suitable manner, such as by welds 191. In this manner, the magnetic field lines 187, 189 are contained and directed through the flanges 185 and the armature 105 as shown in FIG. 4.

Figure 6:
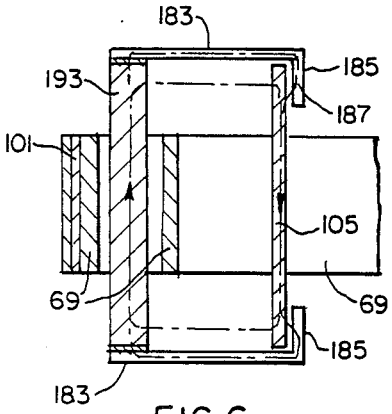
FIGS. 5–7 are sectional views of other embodiments of the invention.

Another embodiment of the invention is shown in FIG. 6 in which a magnet 193 has a flat, rather than a channel, configuration. This embodiment is effective to perform the function of the embodiments shown in FIGS. 4 and 5. However, the embodiment of FIG. 6 is less effective than the channel are U-shaped embodiments of the FIGS. 4 and 5, because the magnetic field also flows through the air space between the ends of the magnet 193 and the armature 105 when the legs 183 become saturated.

Figure 7:
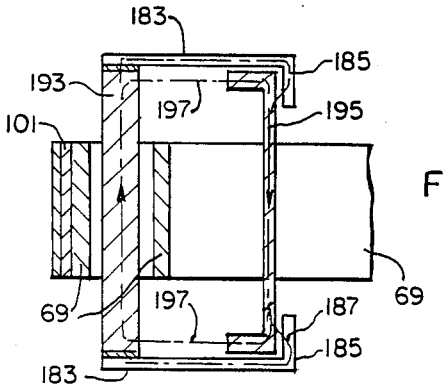

Another embodiment of the invention is disclosed in FIG. 7 in which the magnet 193 having a flat configuration is provided with an armature 195 having a channel configuration, rather than the flat configuration of the channel 105 in FIG. 6. As a result, the space between the ends 196 of the legs of the channel shaped armature 195 are less than those shown in FIG. 6. Accordingly, when the legs 183 become saturated with magnetic field lines 187, additional field lines 197 flow between the magnet 193 and the legs of the channel shaped armature 195.

As shown in FIGS. 1 and 2, the hold-back bracket 179 has a width which is preferably less than the width of the magnet core 103. Indeed, the width of the bracket 179 is substantially half of, and preferably three-eights of, the width of the core 103 when the armature 105 has a thickness of 0.020 inch. If the armature 105 is thicker than 0.020 inch, the width of the hold-back bracket 179 may be less than three-eighths of the width of the core.

The data in the following Table shows the results of tests conducted on existing or prior art devices compared with the device of the present invention having a hold-back bracket. The data shows that with the existing device the main contacts may or may not trip, but the handle indicates that the circuit breaker may be "closed" or "open". However, the device of this invention with the hold-back bracket indicates that the contacts are open when the circuit breaker is tripped.

TABLE

| | $I^2t$ | Ip (KA) | T MS | Main | Branch | Moving Arms |
|---|---|---|---|---|---|---|
| Existing Device | .1 | 10 | 2 | No Trip | Trip | Closed |
| Existing Device | .4 | 18 | 3 | No Trip | Trip | Open |
| Modified Design with Hold-Back Bracket | .2 | 12.5 | 2.3 | Trip | Trip | — |

Accordingly, when the parts and assemblies of the several parts 69, 101, 103, 105, 193, and 195 are accurately fabricated and assembled according to manufacturing standards, the armature 105 functions normally and in response to overcurrent conditions such as short circuits. Finally, in the retracted position under normal current conditions, the armature is retracted with the lower end thereof in contact with the hold-back bracket 179 as shown in FIG. 2. Once armature 105 is in place against the flanges 185 there is an accurate gap between the armature and the core 103 by virtue of factory setting. The knob 117 is a trip knob set by the customer; it is not a calibration means that is necessary for compensating for manufacturing inaccuracies. The knob 117 sets the tension on the spring 113 to set a magnetic trip level. However, there is no thermal adjustment because it is fixed by the contact between the armature 105 and the flanges 185.

What is claimed is:

1. A circuit breaker structure having a hold-back circuit, comprising:

a circuit breaker mechanism having separable contacts and having a releasable member movable to an unlatched position from a latched position to effect opening of the contacts;

a latch lever movable between latched and unlatched positions of the releasable member and being biased in the latched position;

a trip bar movable to unlatch the latch lever and being biased in the latched position;

a trip unit comprising a stationary magnetic structure for each conductor of the distribution system and including a coil and first core assembly and an armature;

lever means associated with each stationary magnetic structure for moving the trip bar to the unlatched position;

the lever means comprising the armature and movable toward the core in response to abnormal currents in at least one of the conductors;

a hold-back bracket comprising a first leg extending from one end of the core and a second leg extending from the other end of the core in the direction of movement of the armature and on opposite sides of the armature so as to increase the magnetic flux density between the core and the armature the core being a U-shaped member having spaced first U-legs with the armature spanning and being movable toward the U-legs in response to a predetermined overcurrent condition, the hold-back bracket being mounted on the core with second U-legs extending along and beyond the ends thereof and beyond the armature, and each second U-leg having an inturned flange adjacent to the armature and which inturned flanges extend toward each other so as to cause magnetic field lines to flow through the flanges and the armature.

2. The circuit breaker of claim 1 in which the hold-back bracket is mounted on the core and comprises a pair of inturned flanges spaced from the core and the armature being disposed between the core and the flanges.

3. The circuit breaker of claim 2 in which the flanges have a width that is about one-half of the width of the second U-legs.

4. The circuit breaker of claim 3 in which the flanges have a width that is three-eighths the width of the second U-legs.

5. The circuit breaker of claim 4 in which the armature has a thickness of about 0.020 inch.

6. The circuit breaker of claim 1 in which the core has a rectangular cross section.

7. The circuit breaker of claim 1 in which each of the core and armature has a rectangular cross section.

8. The circuit breaker of claim 1 in which the armature has a U-shaped cross section.

* * * * *